United States Patent [19]

Shore et al.

[11] 4,273,514

[45] Jun. 16, 1981

[54] WASTE GAS RECOVERY SYSTEMS

[75] Inventors: David Shore, Maidenhead; Robert F. Lintonbon, Weybridge, both of England

[73] Assignee: Ferakarn Limited, London, England

[21] Appl. No.: 949,091

[22] Filed: Oct. 6, 1978

[51] Int. Cl.[3] ..... F04B 49/00

[52] U.S. Cl. ..... 417/15; 417/26; 417/53; 417/292; 417/295; 417/438

[58] Field of Search ..... 55/20, 21, 23, 84, 467; 417/15, 26, 28, 53, 4, 32, 292, 295, 438; 62/93; 60/600-603, 39.53, 728; 123/25; 415/116, 117, 175, 176

[56] References Cited

U.S. PATENT DOCUMENTS

| | | | |
|---|---|---|---|
| 1,346,898 | 7/1920 | Kingsbury | 417/36 X |
| 2,042,991 | 6/1936 | Harris | 417/438 X |
| 2,645,409 | 7/1953 | Lawler | 60/600 X |
| 2,876,865 | 3/1959 | Cobb | 55/23 X |
| 3,091,097 | 5/1963 | Friant | 62/93 X |
| 3,180,266 | 4/1965 | Smith | 417/292 X |
| 3,785,749 | 1/1974 | Perry et al. | 417/28 X |
| 3,799,702 | 3/1974 | Weishaar | 417/38 |
| 3,957,395 | 5/1976 | Ensign | 417/28 X |

FOREIGN PATENT DOCUMENTS

| | | | |
|---|---|---|---|
| 846907 | 9/1939 | France | 417/438 |
| 1506024 | 4/1978 | United Kingdom . | |

OTHER PUBLICATIONS

Processing Magazine, "Flare Gas Recovery Sytem Saves Fuel," By Lintonbon, Feb. 1978.

*Primary Examiner*—Carlton R. Croyle
*Assistant Examiner*—Edward Look

[57] ABSTRACT

A waste gas recovery system employs a compressor which takes in waste gas from an inlet knock-out drum and passes compressed gas to a heat exchanger which cools the gas prior to passage through a further outlet knockout drum. The compressor is driven at a speed which is selected in accordance with the sensed pressure of the incoming waste gas and a valve progressively controls the supply of gas to the compressor inlet in accordance with the sensed pressure. Liquid condensate from the knock-out drums collects in a header tank. A temperature sensing and control arrangement injects liquid from this tank at the inlet to the compressor in the event of an excessive temperature rise at the outlet of the compressor. Gas is also re-circulated from the output of the system to the compressor inlet should the injection of liquid be insufficient to reduce the temperature rise. In the event that the pressure of the waste gas fed to the inlet of the compressor falls below a set minimum value, the control arrangement ensures that the compressor runs with gas re-circulating continuously between the output of the system and the compressor inlet.

13 Claims, 1 Drawing Figure

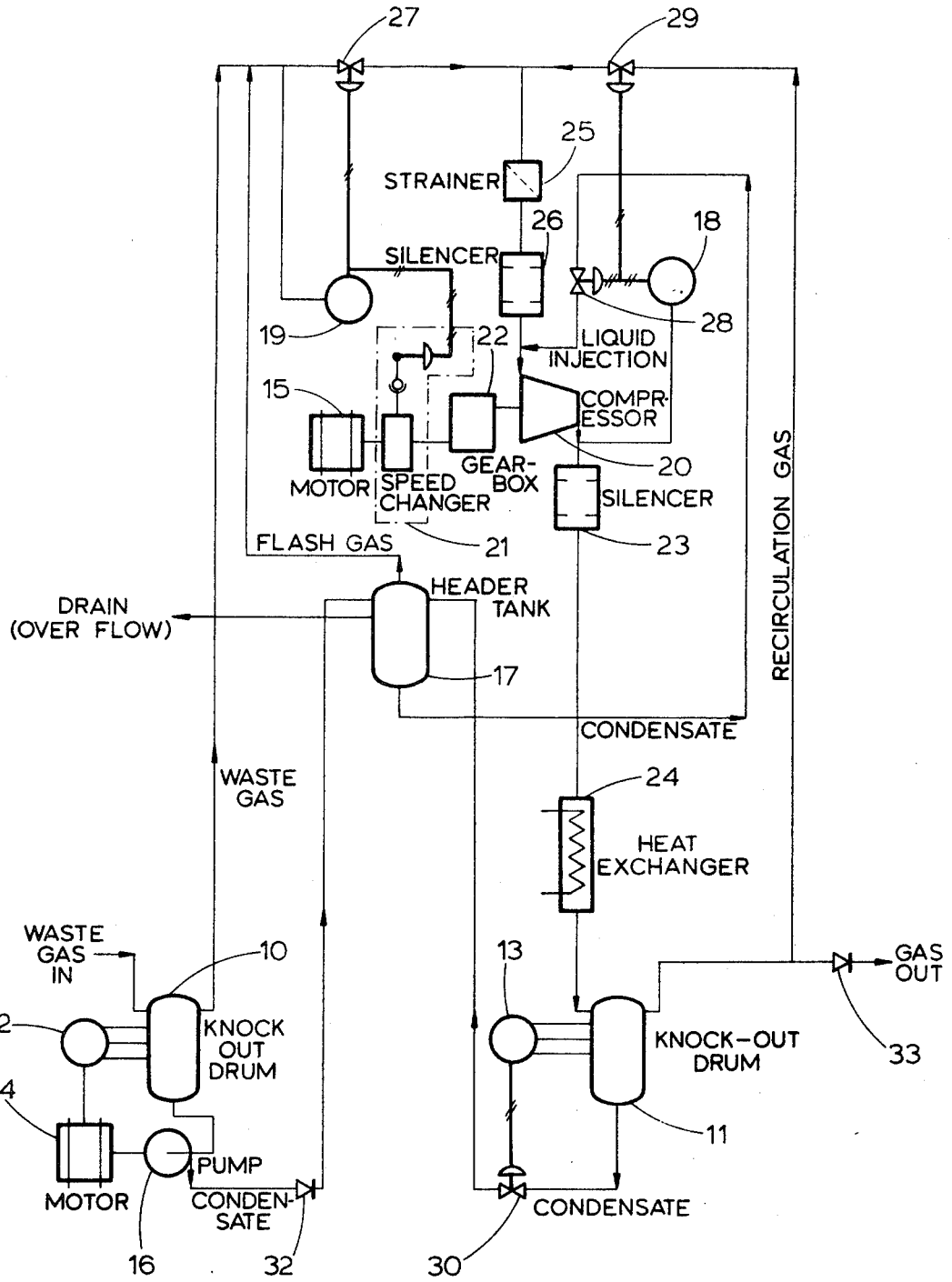
27
29
25
STRAINER
26
18
SILENCER
28
19
22
LIQUID INJECTION
15
COMPR-ESSOR
20
MOTOR
SPEED CHANGER
GEAR-BOX
SILENCER
23
FLASH GAS
21
HEADER TANK
DRAIN (OVER FLOW)
17
RECIRCULATION GAS
CONDENSATE
WASTE GAS
24
HEAT EXCHANGER
WASTE GAS IN
10
13
GAS OUT
12
KNOCK OUT DRUM
KNOCK-OUT DRUM
33
14
11
PUMP
MOTOR
CONDEN-SATE
CONDENSATE
16
32
30

WASTE GAS RECOVERY SYSTEMS

BACKGROUND OF THE INVENTION

The present invention relates in general to a waste gas recovery system.

It is well known to burn off or discharge waste gas arising in process plants used in the oil and chemical industries. Normally, the waste gas is passed to a flare which is elevated and is burnt off at the top of the flare. Nowadays, there is a tendency to utilize recovery systems which process waste gas for utilization as a fuel. There is, however, a need for a flexible recovery system which can be easily integrated with existing plant equipment on site. The recovery system would supplement the normal flare system so that the latter would still operate in abnormal emergency conditions where there is a need to dispose of a large quantity of waste gas. The normal flare system or the recovery system would employ control means to ensure that the waste gas diverted from the flare system for recovery purposes would not be such as to cause air to be drawn into the flare system, thereby creating a dangerous situation. Since the pressure and flow rates of the waste gas can vary over wide ranges in a typical plant, the recovery system should be adapted to cope with such expected variations. Above all, the systems must ensure that the waste gas recovery is achieved in a safe, reliable manner and without adversely affecting the normal flare system. A general object of the present invention is to provide an improved form of recovery system.

SUMMARY OF THE INVENTION

As is known, the present invention relates to a waste gas recovery system which employs a compressor which takes in the raw waste gas and passes the compressed gas to an output and, preferably, through a cooler to the output. In accordance with the invention, parameters are sensed in the system and control functions are initiated to protect the compressor to ensure primarily that the compressor is not starved of gas and does not operate under adverse conditions, leading to excessive temperatures.

In one aspect, the invention provides a method of control, wherein the temperature of the gas at the outlet of the compressor is sensed and control means is operated in dependence on the sensed temperature to cool and stabilize the outlet gas. The control means may comprise valve means which is operated to inject liquid acting as a coolant into the gas entering the compressor. Alternatively, or additionally, the control means may comprise valve means which is operated to pass re-circulatory gas from the output of the overall system back to the inlet of the compressor. The control of the system may additionally or alternatively, involve sensing the pressure of the gas fed to the inlet of the compressor and varying the speed of the compressor in dependence on the sensed pressure. It may be desirable to extend the control so as to comprise sensing the pressure of the gas fed to the inlet of the compressor, varying the speed of the compressor in dependence on the sensed pressure, operating valve means to vary and control the main supply of waste gas to the inlet of the compressor in accordance with the sensed pressure, and operating further valve means to re-circulate gas from the outlet to the inlet of the compressor.

A recovery system made in accordance with the invention may comprise inlet means for receiving the waste gas, a compressor with an inlet connected to the inlet means to receive the waste gas, outlet means connected to an outlet of the compressor to discharge the compressed waste gas, means for sensing the temperature of the waste gas at the outlet of the compressor and temperature control means responsive to the sensing means and operable on the gas fed to the inlet of the compressor to reduce the temperature of the gas at the outlet.

The temperature control means may constitute valve means operable to inject liquid acting as a coolant into the waste gas entering the inlet of the compressor, and/or operable to recycle gas from the outlet of the overall system back to the inlet of the compressor, in the event that the temperature should rise beyond a predetermined value.

In another aspect, a recovery system made in accordance with the invention may comprise means for driving the compressor at a selectable speed and sensing means for sensing the pressure of the waste gas at the inlet means and for controlling the drive means to drive the compressor at a speed commensurate with the sensed pressure.

In the event that the incoming waste gas falls below a pre-determined pressure and the compressor is operating at minimum speed, the compressor can continue to run with the re-circulatory gas preferably cooled with the liquid injection.

It is preferable, also, to utilize one or more knock-out drums to remove liquid as condensate from the waste gas being processed and this liquid can be collected in a header tank and used as the coolant injected into the inlet gas of the compressor.

The invention may be understood more readily and various other features of the invention may become apparent, from consideration of the following description.

BRIEF DESCRIPTION OF DRAWINGS

An embodiment of the invention will now be described, by way of example only, with reference to the accompanying drawing, which is a block schematic representation of a waste gas processing or recovery system made in accordance with the invention.

DESCRIPTION OF PREFERRED EMBODIMENT

As shown in the accompanying drawing, the system consists of a number of units and devices variously interconnected by pipes or conduits defining liquid and gaseous flow paths. More particularly, the system employs two knock-out drums 10,11 respectively, located at the inlet and outlet of the overall system. The drums 10,11 are respectively associated with liquid-level sensing and control devices 12,13. The device 12 controls an electric motor 14, which drives a pump 16, which feeds liquid condensate to a header tank 17 via a non-return valve 32. The device 13 controls a liquid control valve 30 which also supplies liquid condensate to the tank 17. The tank 17 is provided with an overflow or drain which prevents an excessive amount of liquid accumulating in the tank 17. The gas outlet from the knock-out drum 10, together with flash gas which may collect in the header tank 17, is fed via an adjustable-throttle pressure control valve 27, a strainer unit 25 and a silencer 26 to the inlet of a compressor 20. The outlet from the compressor 20 is fed through a silencer 23 and a heat exchanger 24 to the knock-out drum 11. The outlet from the drum 11 is split into two paths. One path passes via a non-return valve 33 to form the outlet "GAS OUT" from the system. The other path is fed back through a temperature control valve 29 and through the strainer unit 28 and the silencer 26 to the inlet of the compressor 20.

The compressor 20 is driven by an electric motor 15, a speed control arrangement or unit 21 and gearing in a gear box 22. The control unit 21 may operate to effect electrical or mechanical speed control.

A temperature sensing and control device 18 senses the temperature prevailing at the outlet of the compressor 20 and controls the valve 29 and a further temperature control valve 28. Liquid condensate is drawn from the header tank 17 and injected into the inlet gas of the compressor 20 when the valve 28 is opened. In an analogous fashion, at least a proportion of the outlet gas is fed back from the outlet of the drum 11 into the inlet of the compressor 20 when the valve 29 is opened.

A pressure sensing and control device 19 senses the pressure prevailing at the outlet from the drum 10 and controls both the valve 27 and the speed control unit 21. According to the pressure prevailing, the drive speed of the compressor 22 is varied and the valve 27 is adjusted progressively to vary its throttle opening.

The operation of the system is as follows:

The waste gas to be processed and arising in a plant enters the drum 10 at "WASTE GAS IN" and a proportion of liquid entrained in the gas condenses in the drum 10. The gas then passes through the normally-open valve 27, through the strainer unit 25 and the silencer 26 into the inlet of the compressor 20. The gas is thence compressed and passes through the silencer 23 and through the heat exchanger 24, which cools the gas, to the drum 11. Liquid entrained in the gas again condenses in the drum 11 and the gas taken from the outlet of the drum 11 is passed through the non-return valve 33 and is suitable to be conveyed into a fuel gas main of the plant.

Variation in the pressure of the incoming gas fed to the compressor 20 is detected by the device 19 and variation in the temperature of the gas at the outlet of the compressor 20 is detected by the device 18. The device 19 directly controls the speed of the compressor drive and the speed of the compressor 20 is automatically varied to compensate for any change in the incoming gas pressure. In addition, the device 19 controls the throttle opening of the valve 27 in accordance with the sensed pressure. This pressure-sensitive control ensures that the compressor 20 operates within a certain speed range and maintains reasonably constant operating characterisitcs to ensure the outlet gas is kept within a desired range of pressure variation. When the compressor 20 is operating at minimum speed, a further reduction in the pressure of the incoming gas could give rise to a temperature rise at the outlet from the compressor 20. At a certain temperature, the device 18 actuates the valve 28, which then injects liquid taken from the header tank 17 into the gas passing into the compressor 20. The liquid tends to cool the gas and the device 18 may cause the valve 28 to cycle and switch on and off to restrict the temperature of the gas at the outlet of the compressor 20. In the event that the injection of fluid is not sufficiently effective to restrict the temperature rise, the valve 29, which is set to switch at a higher temperature than the valve 28, will be opened by the device 18. Gas is now re-circulated from the drum 11 back to the compressor 20 and this gas, which is cooled by the heat exchanger 24, will assist in reducing the temperature of the gas in the compressor 20. In this event, the compressor 20 operates with gas re-circulating between the outlet and inlet and this gas, which is cooled by the heat exchanger 24 and may be additionally cooled by liquid injection, ensures that the compressor 20 is protected.

The units and devices of the system as illustrated and described can be conveniently mounted on one or more skid structures which facilitates installation on site. Certain of the units and devices would need to be adapted to the particular conditions and requirements prevailing. Nevertheless, in a typical system, the compressor 20 can be an Aerzen type VRO 325L/125L, the valves 28,29 can each be a Fisher type 657A or 657R, the devices 18,19 can each be a Taylor Series 440, and the valve 27 can be a GEC Elliot type 7600.

I claim:

1. In a waste gas recovery system with inlet means for receiving the waste gas and a compressor connected to the inlet means and serving to compress the waste gas; the improvement comprising: means for driving the compressor at a selectable speed, first sensing means for sensing the pressure of the waste gas at the inlet means and for controlling the drive means to drive the compressor at a speed commensurate with the sensed pressure, second sensing means for sensing the temperature at the outlet of the compressor and valve means controlled by said second sensing means and operable to inject liquid acting as a coolant into the waste gas entering the inlet of the compressor in the event that the sensed temperature exceeds a pre-determined value.

2. A system according to claim 1 and further comprising further valve means connected between the inlet means and the compressor and controlled by the first sensing means to vary and control the gas fed to the inlet of the compressor in accordance with the sensed pressure.

3. A system according to claim 2 wherein outlet means is connected to the outlet of the compressor and serves to discharge the compressed waste gas for subsequent utilization and there is further provided further valve means controlled by the second sensing means and operable to re-cycle gas from outlet means back to the inlet of the compressor in the event that the sensed temperature exceeds a further pre-determined value greater than the first-mentioned pre-determined value.

4. A system according to claim 1 wherein outlet means is connected to the outlet of the compressor and serves to discharge the compressed waste gas for subsequent utilization and there is further provided further valve means controlled by the second sensing means and operable to re-cycle gas from outlet means back to the inlet of the compressor in the event that the sensed temperature exceeds a further pre-determined value greater than the first-mentioned pre-determined value.

5. A system according to claim 4, wherein the outlet means includes a heat exchanger which cools the compressed waste gas prior to discharge.

6. A system according to claim 4, wherein the outlet means includes a knock-out drum for removing liquid as condensate from the compressed waste gas prior to discharge.

7. A system according to claim 4, wherein the inlet means includes a knock-out drum for removing liquid as condensate from the received waste gas.

8. A system according to claim 1, wherein the liquid which is injected into the gas fed to the inlet of the compressor is taken from a header tank which collects and stores liquid condensate removed from the waste gas.

9. A system according to claim 8, wherein gas present in the header tank is also passed to the inlet of the compressore.

10. In a waste gas recovery system with inlet means for receiving the waste gas, a compressor connected to the inlet means, serving to compress the waste gas and outlet means connected to the compressor and cooling means at the outlet means, the outlet means serving to discharge the compressed waste gas; the improvement comprising: means for driving the compressor at a selectable speed, first sensing means for sensing the pressure of the waste gas at the inlet means and for controlling the drive means to drive the compressor at a speed commensurate with the sensed pressure, second sensing means for sensing the temperature at the outlet of the compressor and valve means in communication with the outlet means downstream of the cooling means and controlled by the second sensing means and operable to re-cycle gas from the outlet means to the inlet of the compressor in the event that the sensed temperature exceeds a pre-determined value.

11. A waste gas recovery system comprising inlet means for receiving the waste gas, a compressor with an inlet connected to the inlet means to receive the waste gas, valve means connected between the inlet means and the inlet of the compressor, outlet means connected to an outlet of the compressor to discharge the compressed waste gas, drive means for driving the compressor at variable controlled speed, means for sensing the pressure of the waste gas at the inlet means and for controlling both the valve means and the drive means in accordance with the sensed pressure, means for sensing the temperature of the waste gas at the outlet of the compressor and temperature control means responsive to the temperature sensing means and operable on the gas fed to the inlet of the compressor in the event that the sensed temperature exceeds a pre-determined value to reduce the temperature of the gas at outlet of the compressor.

12. In a waste gas recovery system with a compressor serving to compress the waste gas; an improved method of control which comprises sensing the pressure of the gas fed to the inlet of the compressor, sensing the temperature of the gas leaving the outlet of the compressor, controlling the drive speed of the compressor in accordance with the sensed pressure and successively controlling separate valve means to inject liquid coolant into the gas fed to the inlet of the compressor and to re-circulate gas from the outlet to the inlet of the compressor at pre-determined sensed temperature values.

13. A method according to claim 12, and further comprising operating further valve means to vary and control the main supply of waste gas to the inlet of the compressor in accordance with the sensed pressure.

* * * * *